US010978009B2

(12) United States Patent
Hsu et al.

(10) Patent No.: US 10,978,009 B2
(45) Date of Patent: Apr. 13, 2021

(54) DISPLAY METHOD OF CURVED DISPLAY PANEL, AND CURVED DISPLAY DEVICE

(71) Applicants: BOE TECHNOLOGY GROUP CO., LTD., Beijing (CN); Chongqing BOE Optoelectronics Technology Co., Ltd., Chongqing (CN)

(72) Inventors: Yihjen Hsu, Beijing (CN); Xiuqin Zhang, Beijing (CN); Lijun Xiao, Beijing (CN); Shaohong Gao, Beijing (CN); Zhiyou Liu, Beijing (CN); Yanan Zhao, Beijing (CN)

(73) Assignees: BOE TECHNOLOGY GROUP CO., LTD., Beijing (CN); CHONGQING BOE OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 16/547,092

(22) Filed: Aug. 21, 2019

(65) Prior Publication Data

US 2020/0066219 A1 Feb. 27, 2020

(30) Foreign Application Priority Data

Aug. 22, 2018 (CN) ..... 201810959205.0

(51) Int. Cl.
*G09G 3/36* (2006.01)
*G09G 3/20* (2006.01)

(52) U.S. Cl.
CPC ..... *G09G 3/3607* (2013.01); *G09G 3/2074* (2013.01); *G09G 2320/0276* (2013.01); *G09G 2320/0673* (2013.01)

(58) Field of Classification Search
None
See application file for complete search history.

(56) References Cited

U.S. PATENT DOCUMENTS

2013/0266771 A1* 10/2013 Kusano ..... H04N 5/64 428/174
2014/0028660 A1 1/2014 Fujimori et al.
2016/0027364 A1* 1/2016 Park ..... G09G 3/20 345/690

(Continued)

FOREIGN PATENT DOCUMENTS

CN 101042478 A 9/2007
CN 105304065 A 2/2016

(Continued)

OTHER PUBLICATIONS

First Office Action dated Jan. 25, 2021, for corresponding Chinese application No. 201810959205.0.

*Primary Examiner* — Duane N Taylor, Jr.
(74) *Attorney, Agent, or Firm* — Nath, Goldberg & Meyer; Joshua R Goldberg

(57) ABSTRACT

The present disclosure provides a display method of a curved display panel, and a curved display device. The display method of the curved display panel according to the present disclosure includes: obtaining a radius of curvature of the curved display panel and acquiring image data, wherein the image data includes a gray scale corresponding to each sub-pixel; and determining a data voltage output to each sub-pixel according to the radius of curvature and a gray scale corresponding to the sub-pixel.

18 Claims, 5 Drawing Sheets

(56) References Cited

U.S. PATENT DOCUMENTS

| | | | | |
|---|---|---|---|---|
| 2016/0231850 | A1 | 8/2016 | Choi | |
| 2019/0312098 | A1* | 10/2019 | Matsueda | G09G 3/3266 |

FOREIGN PATENT DOCUMENTS

| | | | |
|---|---|---|---|
| CN | 107068055 | A | 8/2017 |
| CN | 107564486 | A | 1/2018 |
| CN | 107978230 | A | 5/2018 |

* cited by examiner

DISPLAY METHOD OF CURVED DISPLAY PANEL, AND CURVED DISPLAY DEVICE

CROSS-REFERENCE TO RELATED APPLICATION

This application claims priority to Chinese Patent Application No. 201810959205.0, filed on Aug. 22, 2018, the entire contents of which are hereby incorporated by reference.

TECHNICAL FIELD

The present disclosure relates to the field of display technology, and more particularly, to a display method of a curved display panel and a curved display device.

BACKGROUND

An existing type of curved display panel is formed by bending a flat display panel into a curved surface having a certain radius of curvature. This leads to a change in an illumination area of a sub-pixel in the display panel, which in turn leads to a change in brightness of light emitted by the sub-pixel. An existing display method of the curved display panel includes: determining a data voltage corresponding to each gray scale for each sub-pixel of the display panel in a flat state such that display effect of the entire display panel in the flat state conforms to a desired index, such as a gamma value of 2.2, the maximum brightness and color temperature meet certain requirements, or the like; and then directly driving each sub-pixel to emit light according to a gray scale of the sub-pixel specified in image data by using the data voltage corresponding to the gray scale and determined for the curved display panel in the flat state.

SUMMARY

According to an aspect of the present disclosure, there is provided a display method of a curved display panel. The curved display panel includes a plurality of sub-pixels arranged in an array, and the display method includes:

obtaining a radius of curvature of the curved display panel and acquiring image data, wherein the image data includes a gray scale corresponding to each sub-pixel; and determining a data voltage output to each sub-pixel according to the radius of curvature and a gray scale corresponding to the sub-pixel.

In some embodiments, before obtaining the radius of curvature of the curved display panel and acquiring image data, the display method further includes a step of establishing, for each of the plurality of sub-pixels, a lookup table corresponding to each radius of curvature, wherein the lookup table corresponding to each radius of curvature established for each of the plurality of sub-pixels includes a correspondence between a gray scale of the sub-pixel in image data of a previous frame, a gray scale of the sub-pixel in image data of a current frame, and a gray scale of the sub-pixel actually displayed in the current frame.

In some embodiments, determining the data voltage output to each sub-pixel according to the radius of curvature and the gray scale corresponding to the sub-pixel includes:

determining the lookup table corresponding to the radius of curvature;

searching, in the lookup table corresponding to the radius of curvature, for the gray scale of the sub-pixel actually displayed in the current frame according to the gray scale of the sub-pixel in the image data of the previous frame and the gray scale of the sub-pixel in the image data of the current frame; and determining the data voltage output to the sub-pixel according to the gray scale actually displayed in the current frame.

In some embodiments, sub-pixels in a same column of the array share a same lookup table corresponding to each radius of curvature, and the step of establishing a lookup table corresponding to each radius of curvature for each of the plurality of sub-pixels includes establishing, for each column of sub-pixels, a lookup table corresponding to each radius of curvature.

In some embodiments, one or two columns of sub-pixels having a same distance from a centerline of the display panel in a column direction share a same lookup table corresponding to each radius of curvature, and the step of establishing a lookup table corresponding to each radius of curvature for each of the plurality of sub-pixels includes establishing a lookup table corresponding to each radius of curvature for every one or two columns of sub-pixels having the same distance from the centerline of the display panel in the column direction.

In some embodiments, the step of establishing a lookup table corresponding to each radius of curvature for one of the plurality of sub-pixels includes:

measuring a brightness of the sub-pixel corresponding to each gray scale when the curved display panel is in a flat state;

bending the display panel in the flat state into the curved display panel having the radius of curvature;

driving the curved display panel to display a first gray scale and a second gray scale sequentially;

measuring a brightness of the sub-pixel displaying the second gray scale, and determining a third gray scale corresponding to the measured brightness, wherein a brightness of the sub-pixel displaying the third gray scale when the curved display panel is in the flat state is equal to the brightness of the sub-pixel of the curved display panel displaying the second gray scale; and recording, in the lookup table corresponding to the radius of curvature, that in response to the gray scale of the sub-pixel in the image data of the previous frame being the first gray scale and the gray scale of the sub-pixel in the image data of the current frame being the third gray scale, the gray scale actually displayed by the sub-pixel is the second gray scale.

In some embodiments, the display method further includes, before obtaining the radius of curvature of the curved display panel and acquiring the image data, a step of establishing a correspondence between a plurality of gamma reference voltage groups and different radii of curvature of the curved display panel, each of the gamma reference voltage groups corresponding to one of the radii of curvature, and the step includes:

determining a plurality of gamma reference voltage groups corresponding to different test gamma values for the display panel in the flat state, and selecting one of the plurality of gamma reference voltage groups as an expected gamma reference voltage group, the gamma value corresponding to the expected gamma reference voltage group being an expected gamma value;

obtaining a first gamma value corresponding to brightnesses actually displayed according to the expected gamma reference voltage group and measured after the display panel is bent into the curved display panel having the radius of curvature;

selecting a second gamma value corresponding to the first gamma value from the test gamma values, wherein the second gamma value is in a direction opposite to the first gamma value relative to the expected gamma value; and using the gamma reference voltage group corresponding to the second gamma value as the gamma reference voltage group corresponding to the radius of curvature.

In some embodiments, determining the data voltage output to each sub-pixel according to the radius of curvature and the gray scale corresponding to the sub-pixel includes:

determining, according to the radius of curvature, a corresponding gamma reference voltage group from the plurality of gamma reference voltage groups; and determining the data voltage of the sub-pixel according to the determined gamma reference voltage group and the gray scale of the sub-pixel.

According to another aspect of the present disclosure, there is provided a curved display device including a curved display panel and a driving module for driving the curved display panel, wherein the curved display panel includes a plurality of sub-pixels arranged in an array, and the driving module includes: an acquisition unit, a calculation unit, and an output unit;

the acquisition unit is configured to obtain a radius of curvature of the curved display panel and acquire image data, wherein the image data includes a gray scale corresponding to each sub-pixel;

the calculation unit is configured to determine a data voltage output to each sub-pixel according to the radius of curvature and the gray scale corresponding to the sub-pixel; and the output unit is configured to output a corresponding data voltage to the sub-pixel according to the data voltage determined by the calculation unit.

In some embodiments, the calculation unit is further configured to establish, for each of the plurality of sub-pixel, a lookup table corresponding to each radius of curvature, wherein the lookup table corresponding to each radius of curvature established for each of the plurality of sub-pixels includes a correspondence between a gray scale of the sub-pixel in image data of a previous frame, a gray scale of the sub-pixel in image data of a current frame, and a gray scale actually displayed by the sub-pixel in the current frame.

In some embodiments, the calculation unit is configured to:

determine the lookup table corresponding to the radius of curvature;

search, in the lookup table corresponding to the radius of curvature, for the gray scale actually displayed by the sub-pixel in the current frame according to the gray scale of the sub-pixel in the image data of the previous frame and the gray scale of the sub-pixel in the image data of the current frame; and determine the data voltage output to the sub-pixel according to the gray scale actually displayed in the current frame.

In some embodiments, sub-pixels in a same column of the array share a same lookup table corresponding to each radius of curvature, and the calculation unit is configured to establish, for each column of sub-pixels, a lookup table corresponding to each radius of curvature.

In some embodiments, one or two columns of sub-pixels having a same distance from a centerline of the display panel in a column direction share a same lookup table corresponding to each radius of curvature, and the calculation unit is configured to establish a lookup table corresponding to each radius of curvature for every one or two columns of sub-pixels having the same distance from the centerline of the display panel in the column direction.

In some embodiments, the calculation unit is configured to:

determine, according to the radius of curvature, a corresponding preferred gamma reference voltage group from a plurality of pre-stored gamma reference voltage groups, wherein each gamma reference voltage group corresponds to one of different radii of curvature of the curved display panel; and determine the data voltage of the sub-pixel according to the preferred gamma reference voltage group and the gray scale corresponding to the sub-pixel.

In some embodiments, the acquisition unit and the calculation unit are integrated within a timing control chip, and the output unit is integrated within a source driver chip.

According to still another aspect of the present disclosure, there is provided a curved display device including a curved display panel and a driving module for driving the curved display panel, wherein the curved display panel includes a plurality of sub-pixels arranged in an array, and the driving module includes a memory configured to store instructions and a processor capable of executing the instructions to perform the display method according to the present disclosure.

DETAILED DESCRIPTION

In order to enable those skilled in the art to better understand the technical solutions of the present disclosure, the present disclosure will be further described in detail below with reference to the accompanying drawings and specific implementations.

Brightness of light emitted by a sub-pixel in a curved display panel having a certain radius of curvature formed by bending a flat display panel is different from brightness of light emitted by the sub-pixel in the display panel in the flat state, which in turn causes distortion of display brightness of the curved display panel. In order to at least partially solve the problem of brightness distortion of the existing curved display panel, the present disclosure provides, inter alia, a display method of a curved display panel and a curved display device.

Figure 1:
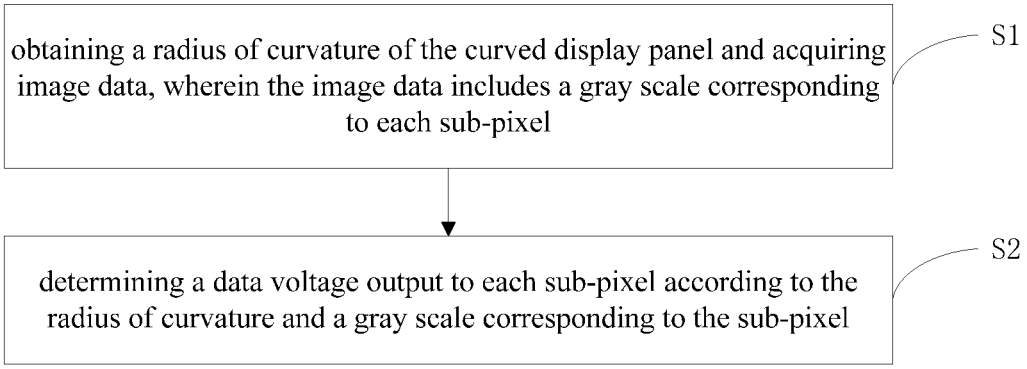
FIG. 1 is a flow chart of a display method of a curved display panel according to an embodiment of the present disclosure.

According to an aspect of the present disclosure, embodiments of the present disclosure provide a display method of a curved display panel. The curved display panel includes a plurality of sub-pixels arranged in an array, and as shown in FIG. 1, the display method includes steps S1 and S2.

Step S1 includes: obtaining a radius of curvature of the curved display panel and acquiring image data, the image data including a gray scale corresponding to each sub-pixel.

It should be noted that the radius of curvature of the curved display panel represents the radius of curvature of the curved display panel in the current state, and is generally constant during display, and therefore, the radius of curvature of the curved display panel only needs to be obtained once. The image data needs to be acquired continuously one frame by one frame because the image data of different frames may be different. The gray scale to be displayed by each sub-pixel in the curved display panel is indicated in the image data.

Step S2 includes: determining a data voltage output to each sub-pixel according to the radius of curvature and the gray scale corresponding to the sub-pixel.

A change in an illumination area of the sub-pixel from the initial flat display panel to the curved display panel formed by bending the flat display panel can be determined according to the radius of curvature, so that influence caused by the change in the illumination area can be compensated for in a subsequent step. After the initial flat display panel is bent into a curved display panel, the illumination area of a sub-pixel may become larger, leading to a decrease in brightness, as such, a data voltage output to the sub-pixel can be increased, thereby compensating for the decrease in brightness.

The magnitude of the data voltage output to any one sub-pixel depends not only on the gray scale corresponding to the sub-pixel in the image data but also on the radius of curvature of the curved display panel. As such, the brightness of light emitted by the sub-pixel is compensated, thereby alleviating distortion of brightness displayed by the entire curved display panel.

Figure 2:
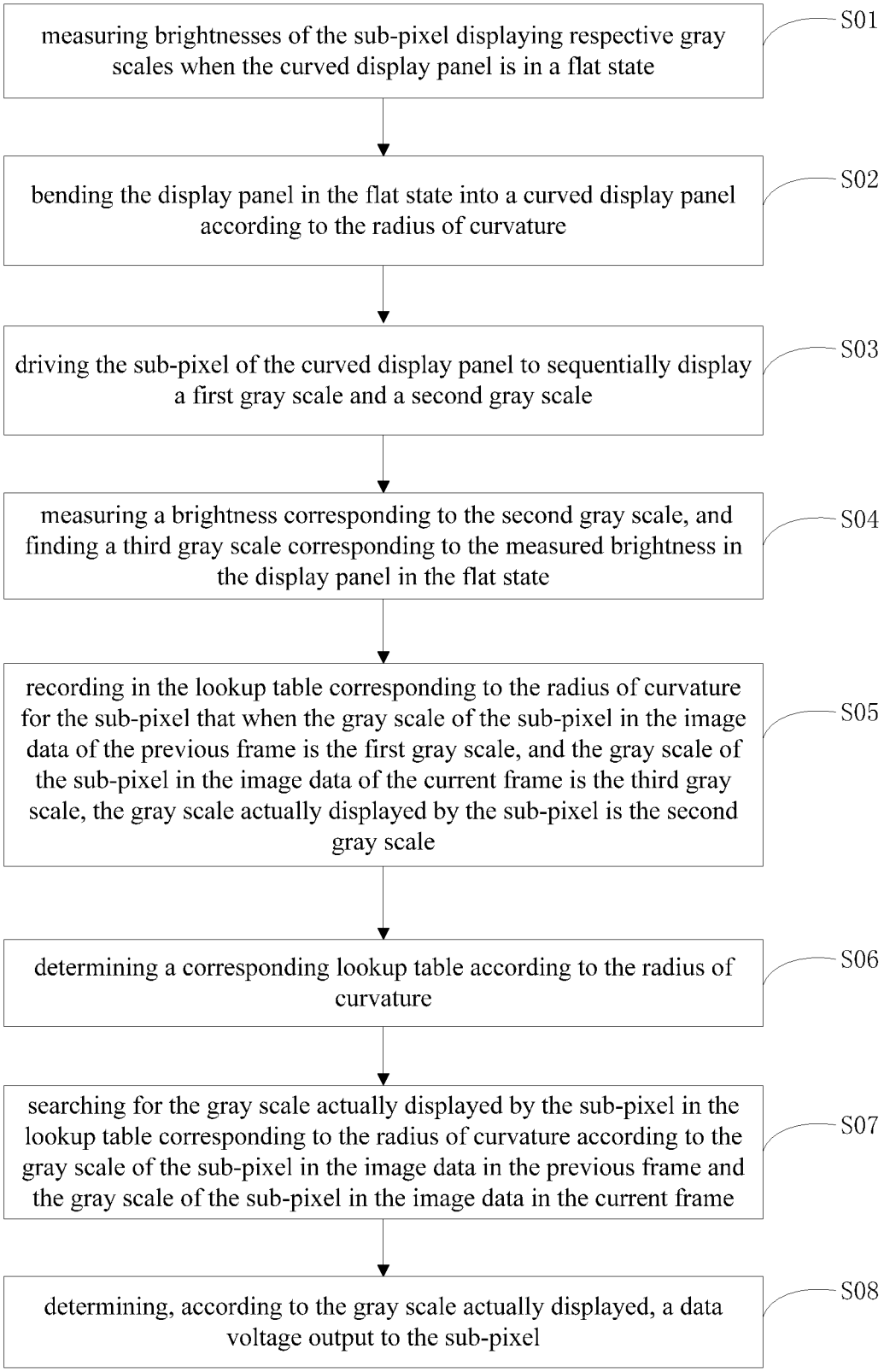
FIG. 2 is a flow chart of a display method of a curved display panel according to an embodiment of the present disclosure.

In some embodiments, as shown in FIG. 2, a display method of a curved display panel includes: firstly establishing a lookup table corresponding to each radius of curvature. The lookup table reflects a correspondence between a gray scale of a sub-pixel in image data of a previous frame, a gray scale of a sub-pixel in image data of a previous frame and a gray scale actually displayed by the sub-pixel in the current frame, and the correspondence may serve as a basis for subsequent adjustment.

In some embodiments, establishing a lookup table corresponding to each radius of curvature may include establishing, for each sub-pixel, a lookup table corresponding to each radius of curvature.

Hereinafter, a process of establishing a lookup table corresponding to each radius of curvature for one of the plurality of sub-pixels is described, and the process may include the following steps S01 to S08.

Step S01 includes: measuring brightnesses of the sub-pixel displaying respective gray scales when the curved display panel is in a flat state. At this time, the brightnesses corresponding to the respective gray scales in the display panel in the flat state should have been adjusted to conform to the current index, for example, the gamma value of the display panel has been adjusted to the expected gamma value of 2.2.

Step S02 includes: bending the display panel in the flat state into a curved display panel according to the radius of curvature. That is, the display panel in the flat state is bent into the curved display panel having the radius of curvature.

Step S03 includes: driving the sub-pixel of the curved display panel to sequentially display a first gray scale and a second gray scale (display is performed in the same manner as in the display panel in the flat state).

Step S04 includes: measuring a brightness corresponding to the second gray scale, and finding a third gray scale corresponding to the measured brightness, the brightness corresponding to the third gray scale displayed by the sub-pixel when the display panel is in the flat state being equal to the brightness corresponding to the second gray scale displayed by the sub-pixel in the curved display panel having the radius of curvature. For example, the sub-pixel is a red sub-pixel, which first displays a red gray scale L16 (first gray scale), and then displays a red gray scale L36 (second gray scale), and measurement finds that the brightness when the sub-pixel in the curved display panel displays the red gray scale L36 is equal to the brightness when the sub-pixel in the display panel in the flat state displays the red gray scale L32 (third gray scale).

Step S05 including: recording in the lookup table corresponding to the radius of curvature for the sub-pixel that when the gray scale of the sub-pixel in the image data of the previous frame is the first gray scale, and the gray scale of the sub-pixel in the image data of the current frame is the third gray scale, the gray scale actually displayed by the sub-pixel is the second gray scale.

Taking a case where the curved display panel displays 256 gray scales L0 to L255 as an example, for each sub-pixel, steps S02 to S04 need to be repeatedly executed 256×256 times, thereby obtaining all combinations of the first gray scale and the second gray scale.

Referring back to the previous example, it can be known from the measurement result of step S04, the sub-pixel displays the red gray scale L16 (first gray scale) in the previous frame, and displays the red gray scale L32 (third gray scale) in the current frame, however, the gray scale that actually needs to be displayed by the sub-pixel is the red gray scale L36 (second gray scale), and therefore the brightness of the sub-pixel needs to be compensated.

The following table is an example showing part of the lookup table, where the abscissa represents the first gray scale (i.e., the gray scale of the sub-pixel specified in the image data in the previous frame), and the ordinate represents the third gray scale (i.e., the gray scale of the sub-pixel specified in the image data in the current frame), and each specific value represents a gray scale that the sub-pixel is currently driven to actually display. Only part of gray scales corresponding to the sub-pixel of a certain color are listed in the table below.

| 0D | 0 | 64 | 128 | 176 | 250 |
|---|---|---|---|---|---|
| 0 | 0 | 0 | 0 | 0 | 0 |
| 64 | 70 | 64 | 54 | 50 | 40 |
| 128 | 151 | 160 | 128 | 117 | 99 |
| 176 | 195 | 190 | 181 | 176 | 157 |
| 250 | 255 | 250 | 250 | 250 | 250 |

That is, after the above lookup table is obtained through measurement, the curved display panel is driven according to the lookup table (specifically including the subsequent steps S06 to S08 in FIG. 2). For a same batch of curved display panels, only one or several of them needs to be measured to obtain the above tables, and all curved display panels of the batch are driven by a same display method.

Needless to say, the same batch of flat display panels may be bent into curved display panels having different radii of curvature, and for each of the different radii of curvature, a lookup table for each sub-pixel is established according to the above method. The established lookup tables may be stored in each curved display panel of the batch. For a curved display panel formed by bending and having a fixed radius of curvature, one lookup table corresponding to the fixed radius of curvature may be established and stored for each sub-pixel. For a curved display panel formed by bending and capable of switching among multiple radii of curvature, multiple lookup tables respectively corresponding to the multiple radii of curvature need to be established and stored for each sub-pixel.

It should be noted that, in the above step S01, when the display panel is in the flat state, the brightnesses corresponding to all sub-pixels displaying a gray scale can be simultaneously measured. For example, all sub-pixels of the display panel can be driven to simultaneously display the gray scale L0, and then brightnesses corresponding to all sub-pixels of the display panel displaying the gray scale L0 are simultaneously measured; then all sub-pixels of the display panel can be driven to simultaneously display the gray scale L1, and then brightnesses corresponding to all sub-pixels of the display panel displaying the gray scale L1 are simultaneously measured; and so on, until all of the sub-pixels of the driving display panel simultaneously display the gray scale L255, and brightnesses corresponding to all of the sub-pixels of the display panel displaying the gray scale L255 are simultaneously measured. Similarly, in step S04, the brightnesses corresponding to all of the sub-pixels displaying the second gray scale can also be measured simultaneously. It should also be noted that the gray scales actually displayed by respective sub-pixels differ depending on the changes in illumination areas of the sub-pixels. In order to further improve the accuracy of the compensation, the gray scale actually displayed may also be a gray scale having one or more digits after the decimal point, for example, 151.5, which indicates that the data voltage actually applied to the sub-pixel is the average of the data voltages of the gray scales L151 and L152, and so on.

Generally, changes in the illumination areas of different columns of sub-pixels may be different, the shorter the distance of a sub-pixel from the centerline of the display panel in a column direction, the larger the change in the illumination area of the sub-pixel, and changes in the illumination areas of all sub-pixels in a same column are the same. Further, changes in the illumination areas of two columns of sub-pixels having a same distance from the centerline of the display panel in the column direction are the same, that is, the changes in the illumination areas of the two columns of sub-pixels that are symmetric with respect to the centerline are the same. A curved display panel formed by bending a flat display panel is generally symmetric with respect to its centerline in a column direction thereof (in a case where the display panel has 2n columns (n is an integer greater than or equal to 1), the centerline is located right in the middle of the nth column and the (n+1)th column, and in a case where the display panel has 2n+1 columns, the (n+1)th column may serve as the centerline). For example, in the case where the display panel includes 2n columns of sub-pixels, the changes in the illumination areas of the n-th and (n+1)th columns of sub-pixels is the largest, and the two columns are symmetric with respect to the centerline of the display panel in the column direction (i.e., the distances of the two columns from the centerline are equal), so the changes of the illumination areas in the two columns are substantially the same. For another example, in the case where the display panel includes 2n+1 columns of sub-pixels, the illumination areas of the (n+1)th column of sub-pixels have the largest changes, and the nth and (n+2)th columns are symmetric with respect to the centerline (i.e., the (n+1)th column) of the display panel in the column direction, so the changes in the illumination areas of the two columns of sub-pixels are substantially the same, and the changes are slightly smaller than the changes in the illumination areas of the (n+1)th column of sub-pixels.

In some embodiments, sub-pixels in a same column share the lookup tables, that is, the lookup tables apply to all sub-pixels in the column. In this case, establishing a lookup table corresponding to each radius of curvature includes: establishing, for each column of sub-pixels, a lookup table corresponding to each radius of curvature. This simplifies the process of establishing the lookup tables. In a case where the display panel includes a plurality of data lines and each of which is connected to one column of sub-pixels, each data line corresponds to one lookup table during display. The process of establishing a lookup table corresponding to each radius of curvature for each column of sub-pixels may refer to the above process of establishing a lookup table corresponding to each radius of curvature for each sub-pixel, but the above steps S01 to S05 only need to be performed on any one sub-pixel in each column of sub-pixels. For example, the brightnesses of only one row of sub-pixels may be measured during the measurement of steps S01 and S04 without measuring the brightness of every sub-pixel.

Since the changes in the illumination areas of the two columns of sub-pixels that are symmetric with respect to the centerline (i.e., their distance from the centerline are equal) are substantially the same, in some embodiments, for each of the radii of curvature, sub-pixels having equal distance from the centerline of the display panel in the column direction may share one lookup table, which further reduces the number of lookup tables, and further simplifies the process of establishing the lookup tables. In a case where the display panel includes 2n columns of sub-pixels, at most n lookup tables are established for each radius of curvature (in a case where there is nearly no change of illumination areas in one or more columns at the edge, the lookup table may not be additionally created or one lookup table may be shared). In a case where the display panel includes 2n+1 columns of sub-pixels, at most n+1 lookup tables are established for each radius of curvature.

It can be understood that the longer the distance of a sub-pixel from the centerline of the display panel in the column direction, the smaller the change in the illumination area of the sub-pixel, and in a case where the distance exceeds a certain value, the illumination area of the sub-pixel hardly changes, so it can be considered that the changes in the illumination areas of one or more columns of sub-pixels at the edge in the column direction is zero. The number of columns of sub-pixels whose changes in the illumination areas are 0 depends on the radius of curvature of the formed curved display panel. In some embodiments, if it is detected that the illumination areas of some columns of sub-pixels barely change (when a difference between the brightness of each sub-pixel in the columns displaying any one gray scale when the display panel is in the flat state and the brightness of the sub-pixel displaying the one gray scale when the display panel is bent to a curved display panel is less than a threshold value, it can be considered that the illumination areas of the columns of sub-pixels barely change), all of the sub-pixels in these columns may share the look-up table, thereby further reducing the number of the look-up tables, which further simplifies the process of creating the lookup tables. After the step of establishing the lookup table, the step of driving the curved display panel for display is followed. In some embodiments, determining the data voltage output to each sub-pixel according to the radius of curvature and the gray scale corresponding to the sub-pixel may include the following steps S06 to S08.

Step S06 includes: determining a corresponding lookup table according to the radius of curvature. The lookup table corresponding to the radius of curvature for the pixel includes relationship between a gray scale actually displayed by the sub-pixel in the current frame and gray scales of the sub-pixel in the image data in the previous frame and in the current frame.

Step S07 includes: searching for the gray scale actually displayed by the sub-pixel in the lookup table corresponding to the radius of curvature according to the gray scale of the sub-pixel in the image data in the previous frame and the gray scale of the sub-pixel in the image data in the current frame.

Referring to the foregoing table, for example, if the image data of the previous frame specifies that the sub-pixel displays gray scale L64, and the image data of the current frame specifies that the sub-pixel displays gray scale L176, and the gray scale actually displayed is found to be L190.

Step S08 includes: determining, according to the gray scale actually displayed, a data voltage output to the sub-pixel (the correspondence between the gray scale and the data voltage in a curved display panel is the same as the correspondence in the display panel in the flat state).

Referring back to the previous example, when the gray scale actually displayed is determined to be L190, the data voltage corresponding to the gray scale L190 is supplied to the sub-pixel, so that the brightness of light actually emitted by the sub-pixel is substantially equal to the brightness of light emitted by the sub-pixel displaying the gray scale L176 when the display panel is in the flat state.

With the display method provided by the embodiments of the present disclosure, it is possible to compensate only the image data without changing the data voltage corresponding to each gray scale determined when the curved display panel is in the flat state (because what is changed is the gray scale), so that the display brightness of the curved display panel can be the consistent with the display brightness of the display panel in the flat state.

Figure 3:
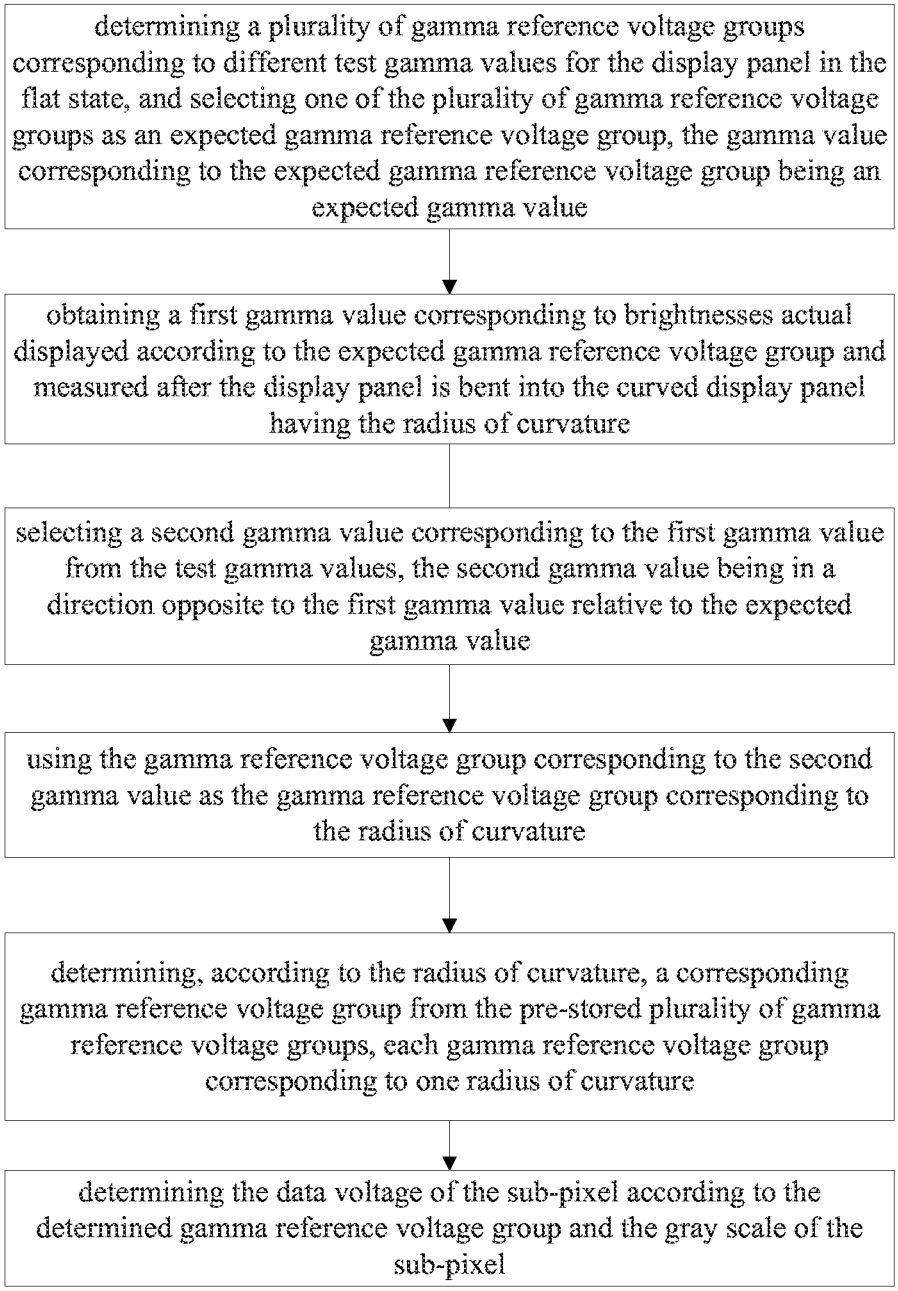
FIG. 3 is a flowchart of a display method of a curved display panel according to an embodiment of the present disclosure.

In some embodiments, as shown in FIG. 3, the display method of the curved display panel may include: first establishing a correspondence between radii of curvature and gamma reference voltage groups, then selecting a corresponding gamma reference voltage group according to a radius of curvature of the curved display panel, and driving the curved display panel according to the gamma reference voltage group. Here, the image data may not be compensated for.

Establishing the correspondence between the radii of curvature and the gamma reference voltage groups may include: determining a plurality of gamma reference voltage groups of the display panel in the flat state corresponding to different test gamma values, and selecting one of the plurality of gamma reference voltage groups as an expected gamma reference voltage group, the gamma value corresponding to the expected gamma reference voltage group being an expected gamma value.

Each gamma value (a value, such as 2.2) corresponds to one gamma reference voltage group, and each gamma reference voltage group includes a plurality of gamma reference voltages, the data voltage corresponding to each gray scale can be obtained using the gamma reference voltages, and in the meanwhile, a gamma curve, which indicates a correspondence between gray scale and relative brightness, can be obtained. That is, for a same gray scale, the data voltage and the brightness corresponding thereto are different under different gamma values (gamma reference voltage groups).

In some embodiments, the step of determining a plurality of gamma reference voltage groups of the display panel in the flat state corresponding to different test gamma values, and selecting one of the plurality of gamma reference voltage groups as an expected gamma reference voltage group includes: adjusting the gamma reference voltage group that drives the display panel in the flat state, measuring brightnesses of different gray scales of the display panel in the flat state, thereby obtaining a plurality of gamma reference voltage groups respectively corresponding to different gamma values of 2.0, 2.1, 2.2, 2.3, 2.4, etc., and selecting one of the gamma values as the expected gamma value and one of the gamma reference voltage groups as the expected gamma reference voltage group. In practical applications, 2.2 is generally selected as the expected gamma value, that is, the brightnesses of different gray scales of each display panel are expected to conform to the curve of gamma value 2.2. Needless to say, in order to give consideration to other display indicators (such as overall brightness), another value may also be selected as the expected gamma value.

Establishing the correspondence between the radii of curvature and the gamma reference voltage groups further includes: obtaining a first gamma value corresponding to brightnesses actual displayed according to the expected gamma reference voltage group and measured after the display panel is bent into the curved display panel having the radius of curvature.

In this step, the display panel in the flat state is bent according to the radius of curvature, and then, the gamma value of the curved display panel is tested under the condition that the data voltage of each gray scale is still the data voltage specified by the expected gamma reference voltage group, and recorded as the first gamma value (although the data voltage does not change, the actual display effect corresponds to a different gamma value because the area of the sub-pixel changes).

Figure 4:
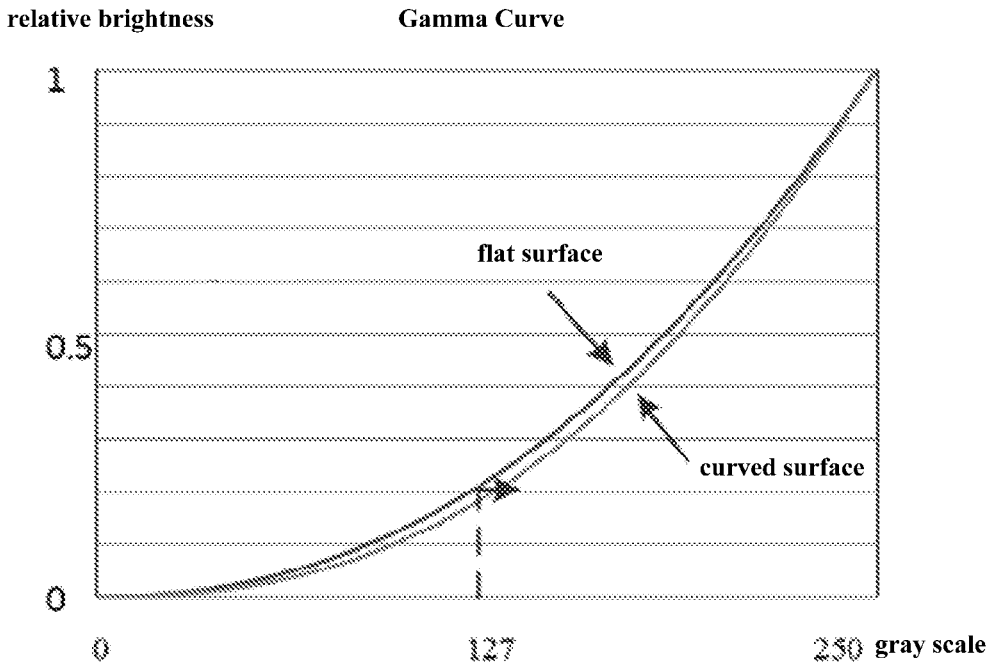
FIG. 4 is a diagram showing relationship between a gamma curve of a curved display panel and a gamma curve of the display panel in a flat state according to an embodiment of the present disclosure.

For example, as shown in FIG. 4, the gamma curve of the display panel in the flat state has a gamma value of 2.2, and it is found that if the data voltage of each gray scale is not adjusted, the gamma curve corresponding to the actual display effect after the display panel in the flat state is bent into a curved display panel according to the radius of curvature has a gamma value of 2.4. Taking the gray scale L127 as an example, after the flat display panel is bent into a curved display panel, if the grayscale voltage is not adjusted, the brightness displayed by the curved display panel is relatively low.

Establishing the correspondence between the radii of curvature and the gamma reference voltage groups further includes: selecting a second gamma value corresponding to the first gamma value from the test gamma values, the second gamma value being in a direction opposite to the first gamma value relative to the expected gamma value.

Referring back to the example shown in FIG. 4, the expected gamma value is 2.2, the first gamma value is 2.4 (larger than the expected gamma value), and then the second gamma value should be less than the expected gamma value, so as to compensate for the brightness loss.

In practical applications, it may be set that the first gamma value and the second gamma value are symmetric with respect to the expected gamma value. That is, referring back to the foregoing example, in this case, the second gamma value is 2.0.

Establishing the correspondence between the radii of curvature and the gamma reference voltage groups further includes: using the gamma reference voltage group corresponding to the second gamma value as the gamma reference voltage group corresponding to the radius of curvature.

That is, the gamma reference voltage group corresponding to the radius of curvature is the gamma reference voltage group corresponding to the second gamma value. Referring back to the foregoing example, in this case, the gamma value corresponding to the curved display panel is 2.0.

After establishing a correspondence between one radius of curvature and the reference voltage group, the correspondence between other radii of curvature and the reference voltage groups can be established by the same method. In this case, determining the data voltage output to each sub-pixel according to the radius of curvature and the gray scale corresponding to sub-pixel may include: determining a corresponding gamma reference voltage group among a plurality of gamma reference voltage groups, which may be pre-stored, according to the radius of curvature, each gamma reference voltage group corresponding to one radius of curvature.

Referring back to the example shown in FIG. 4, for the curved display panels having a certain radius of curvature and formed by bending the flat display panels of a same batch, the preferred gamma reference voltage group corresponding to the radius of curvature has a gamma value of 2.0.

Determining the data voltage output to each sub-pixel according to the radius of curvature and the gray scale corresponding to sub-pixel may further include: determining the data voltage of the sub-pixel according to the determined gamma reference voltage group and gray scale corresponding to the sub-pixel.

Referring back to the example shown in FIG. 4, in this case, a sub-pixel is driven using the gray scale of the sub-pixel specified by the image data in the current frame and the data voltage corresponding to the gray scale specified by the gamma reference voltage group having a gamma value of 2.0.

As such, the curved display panel is driven by selecting, from the gamma reference voltage groups corresponding to different gamma values, a corresponding gamma reference voltage group according to the radius of curvature of the curved display panel, so that the brightness displayed by the curved display panel may be substantially the same as the brightness displayed by the display panel in the flat state without changing the image data.

It should be noted that the methods provided in the foregoing embodiments (e.g., the methods shown in FIG. 2 and FIG. 3) may be simultaneously applied to a same curved display device, that is, two adjustment ways may be simultaneously adopted. The curved display panel is, for example, a curved liquid crystal display panel or a curved OLED display panel. In an extreme case, taking a square-shaped sub-pixel as an example, after the flat display panel is bent into a curved display panel, the square-shaped sub-pixel will become a circular-like sub-pixel under the theoretical limit condition, causing a change in area. The above display method can compensate for the brightness loss of the pixel caused by the change in area to some extent. In particular, in a case where the adjustment by using a single method shown in either FIG. 2 or 3 is still not satisfactory, the methods shown in FIGS. 2 and 3 can be applied simultaneously.

In another aspect, the embodiments provide a curved display device to perform the above display method.

Figure 5:
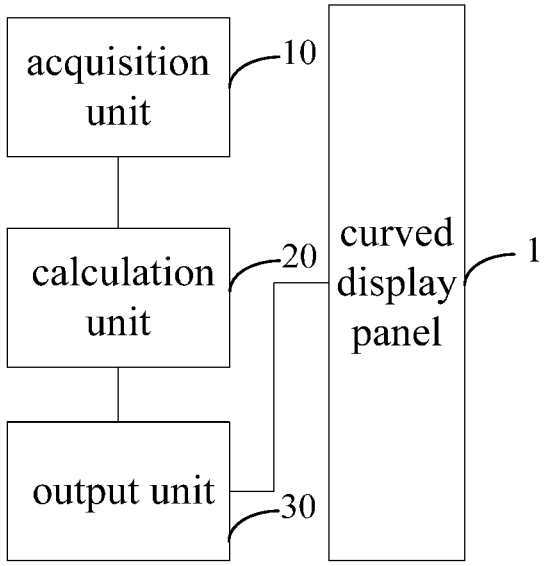
FIG. 5 is a block diagram of a curved display device according to an embodiment of the present disclosure.

As shown in FIG. 5, the curved display device includes a curved display panel 1 and a driving module for driving the curved display panel 1. The curved display panel 1 includes a plurality of sub-pixels arranged in an array, and the driving module includes: an acquisition unit 10, a calculation unit 20, and an output unit 30. The acquisition unit 10 is configured to obtain a radius of curvature of the curved display panel 1 and acquire image data, the image data including a gray scale corresponding to each sub-pixel; the calculation unit 20 is configured to determine a data voltage output to each sub-pixel according to the radius of curvature and the gray scale corresponding to the sub-pixel; and the output unit 30 is configured to convert the data voltage calculated by the calculation unit 20 into an analog signal and output the analog signal to the sub-pixel.

That is, the acquisition unit 10 obtains the radius of curvature of the curved display panel 1, and receives the image data frame by frame. The calculation unit 20 determines the magnitude of the data voltage for each sub-pixel according to the radius of curvature and the image data, and the output unit 30 drives each sub-pixel to perform display according to the calculation result of the calculation unit 20.

In one embodiment, the curved display device may be any product or part having a display function, such as a liquid crystal display module, an organic light emitting diode (OLED) display module, an electronic paper, a mobile phone, a tablet computer, a television, a display, a notebook computer, a digital photo frame, a navigator, and the like.

In some embodiments, the calculation unit 20 may be configured to: determine a corresponding lookup table according to the radius of curvature, the lookup table corresponding to the radius of curvature includes correspondence between gray scales of one sub-pixel in the image data of a previous frame and a current frame and a gray scale actually displayed by the sub-pixel in the current frame; and searching, in the lookup table corresponding to the radius of curvature, the gray scale actually displayed by the sub-pixel according to the gray scale of the sub-pixel in the image data of the previous frame and the gray scale of the sub-pixel in the image data of the current frame; and determine the data voltage output to the sub-pixel according to the gray scale actually displayed.

That is, the calculation unit 20 may determine a corresponding lookup table according to the radius of curvature, and find the gray scale actually displayed by the sub-pixel in the lookup table according to the gray scale of the sub-pixel in the image data of the previous frame and the gray scale of the sub-pixel in the image data of the current frame.

In some embodiments, the calculation unit 20 may be configured to: determine a corresponding gamma reference voltage group from pre-stored plurality of gamma reference voltage groups according to the radius of curvature, each gamma reference voltage group corresponding to one radius of curvature; and determine the data voltage for the sub-pixel according to the determined gamma reference voltage group and the gray scale of the sub-pixel.

That is, the calculation unit 20 selects an appropriate gamma reference voltage group according to the radius of curvature, and outputs the appropriate gamma reference voltage group to the output unit 30. After receiving the data voltage determined by the calculation unit 20 and the image data acquired by the acquisition unit 10, the output unit 30 drives the sub-pixel to perform display according to the gray scale of the sub-pixel specified by the image data and the grayscale voltage specified by the determined gamma reference voltage group.

Figure 6:
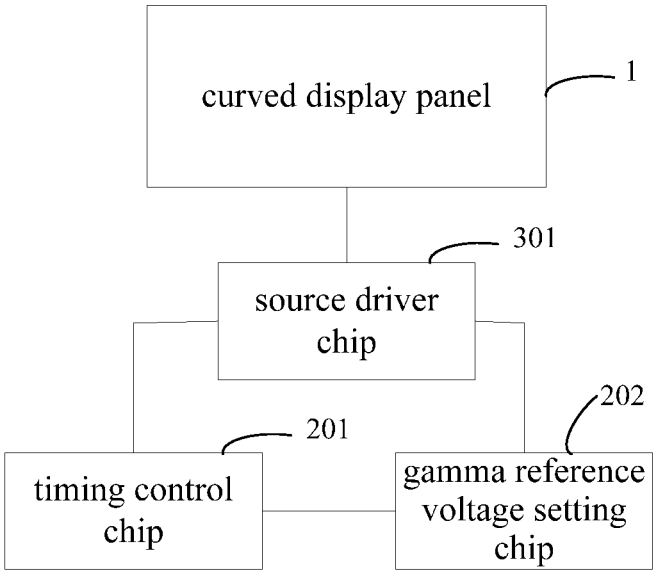
FIG. 6 is a block diagram of an example of a curved display device according to an embodiment of the present disclosure.

In some embodiments, the acquisition unit 10, the calculation unit 20, and the output unit 30 may be implemented as a memory and processor coupled to each other. The memory stores computer-executable instructions, and the processor is caused to implement the functions of the acquisition unit 10, the calculation unit 20, and the output unit 30 described above when executing the computer-executable instructions. Examples of suitable memories include, but are not limited to, magnetic or magnetic tape; optical storage media such as compact discs (CDs) or DVDs (digital versatile discs); flash memory; and other non-transitory media. Optionally, the memory is a non-transitory memory. Needless to say, the driving module according to the embodiments of the present disclosure is not limited thereto, and may also be implemented in other form combining software and hardware. In some embodiments, as shown in FIG. 6, the acquisition unit 10 and the calculation unit 20 may be integrated in a timing control chip (TCON IC) 201, and the output unit 30 may be integrated in a source driver chip (Source Driver IC) 301.

That is, the timing control chip 201 obtains the radius of curvature and the image data, corrects the image data and/or select the gamma reference voltage group in the gamma reference voltage setting chip (P gamma IC) 202, and the source driver chip 301 outputs an analog data voltage to drive the sub-pixel for display.

Figure 7:
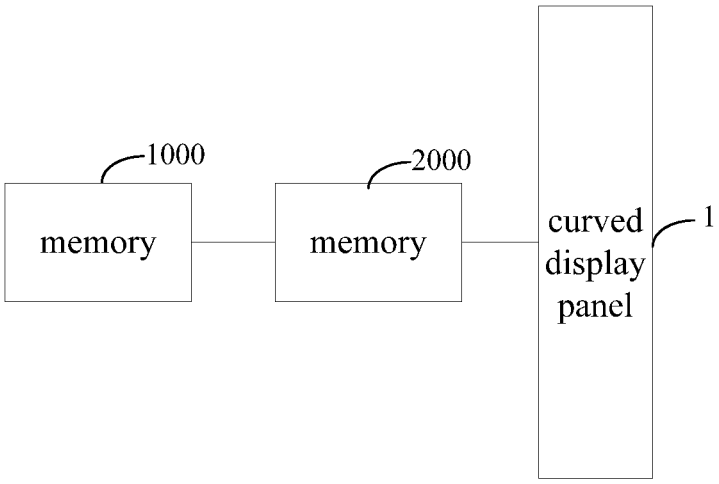
FIG. 7 is a block diagram of a curved display device according to an embodiment of the present disclosure.

In another aspect, an embodiment of the present disclosure provides a curved display device, as shown in FIG. 7, including a curved display panel 1 and a driving module for driving the curved display panel 1. The curved display panel 1 includes a plurality of sub-pixels arranged in an array. The driving module includes a memory 1000 that stores instructions and a processor 2000 that executes instructions to perform the display method according to the embodiments of the present disclosure.

The memory 1000 is, for example, a random access memory (RAM), and the processor 2000 is, for example, a central processing unit (CPU). As another example, the memory 1000 and the processor 2000 are both integrated within an image processing unit (GPU).

It could be understood that the above implementations are merely exemplary implementations employed for explaining the principles of the present disclosure, but the present disclosure is not limited thereto. Various modifications and improvements can be made by those skilled in the art without departing from the spirit and scope of the disclosure, and these modifications and improvements are also considered to fall within the protection scope of the present disclosure.

What is claimed is:

1. A display method of a curved display panel, the curved display panel comprising a plurality of sub-pixels arranged in an array, and the display method comprising:

obtaining a radius of curvature of the curved display panel and acquiring image data, wherein the image data comprises a gray scale corresponding to each sub-pixel; and determining a data voltage output to each sub-pixel according to the radius of curvature and a gray scale corresponding to the sub-pixel.

2. The display method of claim 1, further comprising, before obtaining the radius of curvature of the curved display panel and acquiring image data, a step of establishing, for each of the plurality of sub-pixels, a lookup table corresponding to each radius of curvature, wherein the lookup table corresponding to each radius of curvature established for each of the plurality of sub-pixels comprises a correspondence between a gray scale of the sub-pixel in image data of a previous frame, a gray scale of the sub-pixel in image data of a current frame, and a gray scale actually displayed by the sub-pixel in the current frame.

3. The display method of claim 2, wherein determining the data voltage output to each sub-pixel according to the radius of curvature and the gray scale corresponding to the sub-pixel comprises:

determining the lookup table corresponding to the radius of curvature;

searching, in the lookup table corresponding to the radius of curvature, for the gray scale actually displayed by the sub-pixel in the current frame according to the gray scale of the sub-pixel in the image data of the previous frame and the gray scale of the sub-pixel in the image data of the current frame; and determining the data voltage output to the sub-pixel according to the gray scale actually displayed.

4. The display method of claim 2, wherein establishing, for one of the plurality of sub-pixels, a lookup table corresponding to each radius of curvature comprises:

measuring a brightness of the sub-pixel corresponding to each gray scale when the curved display panel is in a flat state;

bending the display panel in the flat state into the curved display panel having the radius of curvature;

driving the curved display panel to display a first gray scale and a second gray scale sequentially;

measuring a brightness of the sub-pixel displaying the second gray scale, and determining a third gray scale corresponding to the measured brightness, wherein a brightness of the sub-pixel displaying the third gray scale when the curved display panel is in the flat state is equal to the brightness of the sub-pixel of the curved display panel displaying the second gray scale; and recording, in the lookup table corresponding to the radius of curvature, that in response to the gray scale of the sub-pixel in the image data of the previous frame being the first gray scale and the gray scale of the sub-pixel in the image data of the current frame being the third gray scale, the gray scale actually displayed by the sub-pixel is the second gray scale.

5. The display method of claim 2, wherein sub-pixels in a same column of the array share a same lookup table corresponding to each radius of curvature, and the step of establishing a lookup table corresponding to each radius of curvature for each of the plurality of sub-pixels comprises establishing, for each column of sub-pixels, a lookup table corresponding to each radius of curvature.

6. The display method of claim 5, wherein one or two columns of sub-pixels having a same distance from a centerline of the display panel in a column direction share a same lookup table corresponding to each radius of curvature, and the step of establishing a lookup table corresponding to each radius of curvature for each of the plurality of sub-pixels comprises establishing a lookup table corresponding to each radius of curvature for every one or two columns of sub-pixels having the same distance from the centerline of the display panel in the column direction.

7. The display method of claim 1, further comprising, before obtaining the radius of curvature of the curved display panel and acquiring the image data, a step of establishing a correspondence between a plurality of gamma reference voltage groups and different radii of curvature of the curved display panel, each of the gamma reference voltage groups corresponding to one of the radii of curvature, the step comprising:

determining a plurality of gamma reference voltage groups corresponding to different test gamma values for the display panel in the flat state, and selecting one of the plurality of gamma reference voltage groups as an expected gamma reference voltage group, the gamma value corresponding to the expected gamma reference voltage group being an expected gamma value;

obtaining a first gamma value corresponding to brightnesses actual displayed according to the expected gamma reference voltage group and measured after the display panel is bent into the curved display panel having the radius of curvature;

selecting a second gamma value corresponding to the first gamma value from the test gamma values, wherein the second gamma value is in a direction opposite to the first gamma value relative to the expected gamma value; and using the gamma reference voltage group corresponding to the second gamma value as the gamma reference voltage group corresponding to the radius of curvature.

8. The display method of claim 7, wherein determining the data voltage output to each sub-pixel according to the radius of curvature and the gray scale corresponding to the sub-pixel comprises:

determining, according to the radius of curvature, a corresponding gamma reference voltage group from the plurality of gamma reference voltage groups; and determining the data voltage of the sub-pixel according to the determined gamma reference voltage group and the gray scale of the sub-pixel.

9. The display method of claim 4, further comprising, before obtaining the radius of curvature of the curved display panel and acquiring the image data, a step of establishing a correspondence between a plurality of gamma reference voltage groups and different radii of curvature of the curved display panel, each of the gamma reference voltage groups corresponding to one of the radii of curvature, the step comprising:

determining a plurality of gamma reference voltage groups corresponding to different test gamma values for the display panel in the flat state, and selecting one of the plurality of gamma reference voltage groups as an expected gamma reference voltage group, the gamma value corresponding to the expected gamma reference voltage group being an expected gamma value;

obtaining a first gamma value corresponding to brightnesses actual displayed according to the expected gamma reference voltage group and measured after the display panel is bent into the curved display panel having the radius of curvature;

selecting a second gamma value corresponding to the first gamma value from the test gamma values, wherein the second gamma value is in a direction opposite to the first gamma value relative to the expected gamma value; and using the gamma reference voltage group corresponding to the second gamma value as the gamma reference voltage group corresponding to the radius of curvature.

10. The display method of claim 9, wherein determining the data voltage output to each sub-pixel according to the radius of curvature and the gray scale corresponding to the sub-pixel comprises:

determining, according to the radius of curvature, a corresponding gamma reference voltage group from the plurality of gamma reference voltage groups; and determining the data voltage of the sub-pixel according to the determined gamma reference voltage group and the gray scale of the sub-pixel.

11. A curved display device, comprising a curved display panel and a driving module for driving the curved display panel, wherein the curved display panel comprises a plurality of sub-pixels arranged in an array, and the driving module comprises: a memory and a processor coupled to each other, and the processor being configured to function as an acquisition unit, a calculation unit, and an output unit;

the acquisition unit is configured to obtain a radius of curvature of the curved display panel and acquire image data, wherein the image data comprises a gray scale corresponding to each sub-pixel;

the calculation unit is configured to determine a data voltage output to each sub-pixel according to the radius of curvature and the gray scale corresponding to the sub-pixel; and the output unit is configured to output a corresponding data voltage to the sub-pixel according to the data voltage determined by the calculation unit.

12. The display device of claim 11, wherein the calculation unit is further configured to establish, for each of the plurality of sub-pixel, a lookup table corresponding to each radius of curvature, wherein the lookup table corresponding to each radius of curvature established for each of the plurality of sub-pixels comprises a correspondence between a gray scale of the sub-pixel in image data of a previous frame, a gray scale of the sub-pixel in image data of a current frame, and a gray scale actually displayed by the sub-pixel in the current frame.

13. The display device of claim 12, wherein the calculation unit is configured to:

determine the lookup table corresponding to the radius of curvature;

search, in the lookup table corresponding to the radius of curvature, for the gray scale actually displayed by the sub-pixel in the current frame according to the gray scale of the sub-pixel in the image data of the previous frame and the gray scale of the sub-pixel in the image data of the current frame; and determine the data voltage output to the sub-pixel according to the gray scale actually displayed.

14. The display device of claim 12, wherein sub-pixels in a same column of the array share a same lookup table corresponding to each radius of curvature, and the calculation unit is configured to establish, for each column of sub-pixels, a lookup table corresponding to each radius of curvature.

15. The display device of claim 12, wherein one or two columns of sub-pixels having a same distance from a centerline of the display panel in a column direction share a same lookup table corresponding to each radius of curvature, and the calculation unit is configured to establish a lookup table corresponding to each radius of curvature for every one or two columns of sub-pixels having the same distance from the centerline of the display panel in the column direction.

16. The display device of claim 11, wherein the calculation unit is configured to:

determine, according to the radius of curvature, a corresponding gamma reference voltage group from a plurality of pre-stored gamma reference voltage groups, wherein each gamma reference voltage group corresponds to one of different radii of curvature of the curved display panel; and determine the data voltage of the sub-pixel according to the determined gamma reference voltage group and the gray scale corresponding to the sub-pixel.

17. The display device of claim 11, wherein the acquisition unit and the calculation unit are integrated within a timing control chip, and the output unit is integrated within a source driver chip.

18. A curved display device, comprising a curved display panel and a driving module for driving the curved display panel, wherein the curved display panel comprises a plurality of sub-pixels arranged in an array, and the driving module comprises a memory configured to store instructions and a processor capable of executing the instructions to perform the display method of claim 1.

* * * * *